US005878964A

United States Patent [19]

Hansen

[11] Patent Number: 5,878,964

[45] Date of Patent: Mar. 9, 1999

[54] SPRAY NOZZLE WITH TWO OR MORE EQUALLY SIZED ORIFICES

[76] Inventor: Dennis R. Hansen, 36 Edgewood Ave., Mill Valley, Calif. 94941

[21] Appl. No.: 851,073

[22] Filed: May 2, 1997

Related U.S. Application Data

[60] Provisional application No. 60/017,375 May 3, 1996.

[51] Int. Cl.[6] ..... B05B 1/14

[52] U.S. Cl. ..... 239/556; 239/566

[58] Field of Search ..... 239/506, 556, 239/548, 352, DIG. 1, 566

[56] References Cited

U.S. PATENT DOCUMENTS

| | | | |
|---|---|---|---|
| D. 295,890 | 5/1988 | Bruninga et al. | D23/245 |
| D. 361,122 | 8/1995 | Goodin | D23/226 |
| 517,544 | 4/1894 | Dickens . | |
| 532,281 | 1/1895 | Melasen | 239/561 |
| 1,968,396 | 7/1934 | Hollingworth | 299/18 |
| 1,976,030 | 10/1934 | Lighthall | 299/18 |
| 2,007,675 | 7/1935 | Erickson et al. | 299/18 |
| 2,373,353 | 4/1945 | Smith | 239/548 |
| 2,635,009 | 4/1953 | Knight | 239/548 |
| 2,835,532 | 5/1958 | Galloway | 299/60 |
| 2,925,224 | 2/1960 | Cunningham | 239/548 |
| 2,943,798 | 7/1960 | Rienks | 239/520 |
| 2,954,171 | 9/1960 | Hruby | 239/231 |
| 3,081,950 | 3/1963 | Rinkewich | 239/394 |
| 3,104,063 | 9/1963 | Bete | 239/548 |
| 3,266,737 | 8/1966 | Nees | 239/548 |
| 3,504,862 | 4/1970 | Lowry | 239/565 |
| 3,724,763 | 4/1973 | Braun | 239/490 |
| 3,921,912 | 11/1975 | Hayes | 239/242 |
| 4,128,206 | 12/1978 | Bintner | 239/11 |
| 4,154,304 | 5/1979 | Steibing et al. | 239/548 |
| 4,189,099 | 2/1980 | Bruninga | 239/200 |
| 4,646,977 | 3/1987 | Iwamura et al. | 239/590.5 |
| 4,714,200 | 12/1987 | Sayama | 239/579 |
| 4,765,540 | 8/1988 | Yie | 239/8 |
| 4,800,961 | 1/1989 | Klein | 169/37 |
| 4,892,252 | 1/1990 | Bruninga | 239/205 |
| 5,054,692 | 10/1991 | Foster et al. | 239/589 |
| 5,288,022 | 2/1994 | Sesser | 239/205 |
| 5,299,742 | 4/1994 | Han | 239/DIG. 1 |
| 5,415,348 | 5/1995 | Nelson | 239/71 |
| 5,511,727 | 4/1996 | Heren et al. | 239/242 |

FOREIGN PATENT DOCUMENTS

| | | | |
|---|---|---|---|
| 6-86949 | 3/1994 | Japan | 239/548 |

OTHER PUBLICATIONS

The Revolutionary Toro V–1550 Brochure, 4 pp.

*Primary Examiner*—Kevin Weldon
*Attorney, Agent, or Firm*—Christie, Parker & Hale, LLP

[57] ABSTRACT

A nozzle for a rotary water delivery system comprising at least a pair of nozzle orifices of similar size spaced apart on a face of the nozzle and having a nozzle orifice size to nozzle orifice spacing distance ratio of about 1:2 to about 1: 10, said ratio being sufficient to produce separate nozzle streams which emerge from the nozzle face as separate streams which may join together or commingle only at a distance from said face which does not appreciably increase an overall velocity of a resultant stream or commingled stream or individual streams so that the gallonage per minute delivered by the nozzle can be increased incrementally in multiples without appreciably increasing the distance thrown by the resultant water stream.

6 Claims, 5 Drawing Sheets

SPRAY NOZZLE WITH TWO OR MORE EQUALLY SIZED ORIFICES

CROSS REFERENCE TO RELATED APPLICATION(S)

This application claims priority from U.S. Provisional Application No. 60/017,375 filed May 3, 1996.

FIELD OF THE INVENTION

This invention relates to rotary sprinklers and, more specifically, to the discharge nozzle or nozzles utilized by the sprinklers that direct the stream or streams of water away from the sprinkler towards the intended distance radius of the area to be watered by the sprinkler.

BACKGROUND OF THE INVENTION

Typical nozzles primarily increase the gallons per minute delivered by enlarging the primary delivery orifice on the nozzle. It is desirable in practice to increase or decrease the gallons per minute delivered by a sprinkler whenever multiple sprinklers are used within the same piping or valved delivery system that applies water to a given area which requires different patterns or radius from individual sprinklers within the system. The term "matched precipitation" refers to a system comprised of sprinklers within a particular system delivering about the same amount of water to a given area in the same amount of time regardless of the individual radius or areas the individual sprinklers are required to service. This means that a sprinkler set for a 180 degree radius (half circle) on the same circuit as a sprinkler set for a 90 degree radius, needs to deliver twice as much water as the sprinkler set for 90 degrees over the same amount of time. Since these sprinklers are on the same circuit there is no practical means of increasing or decreasing an individual sprinklers operating time.

The current method of attaining matched precipitation is by increasing the nozzle(s) orifice size to incrementally increase the discharge in gallons per minute. For example, a 90 degree sprinkler could use a nozzle set to deliver one gallon per minute, a 180 degree sprinkler could use a nozzle set to deliver two gallons per minute, a 270 degree sprinkler could use a nozzle set to deliver three gallons per minute, and a 360 degree sprinkler could use a nozzle set to deliver four gallons per minute by making the orifice correspondingly larger on the each individual sprinkler nozzle. This method achieves a poor degree of success, in fact, because the distance the nozzles throw the water stream increases as the gallons per minute increases thereby increasing the radius. Mechanical stream interfering devices are currently employed to compensate for the distance (radius) increase, but at great expense of application uniformity. Mechanical interfering devices (commonly screws that extend into the water stream) produce unpredictable results and destroy the physical characteristics of the water stream. Uniformity of application is the goal of matching precipitation rates. Consequently, a need exists for a sprinkler nozzle which can uniformly distribute water without increasing the distance thrown.

SUMMARY OF THE INVENTION

It is therefore the principle object of the present invention to increase the gallons per minute delivered by a spray nozzle in predictable quantities or units without appreciably increasing the radius or distance thrown by the resulting water stream.

This object is accomplished by having equal sized orifices (holes) in a nozzle or nozzles on a sprinkler, the number of which determines the total gallons per minute delivered.

This is beneficial in many aspects, the primary one being to allow sprinklers (or sprinkler nozzles) to deliver about the same amount of water per square foot regardless of the portion of a circle (arc) the rotary sprinkler (or nozzle) covers without depending on radius reducers to deflect the spray stream in given confines to control the distance sprayed. This allows matched precipitation rates and preserves droplet sizes (stream characteristics) and distribution uniformity on sprinklers that rotate in part or full circle patterns.

DETAILED DESCRIPTION OF THE DRAWINGS

Figure 1A:
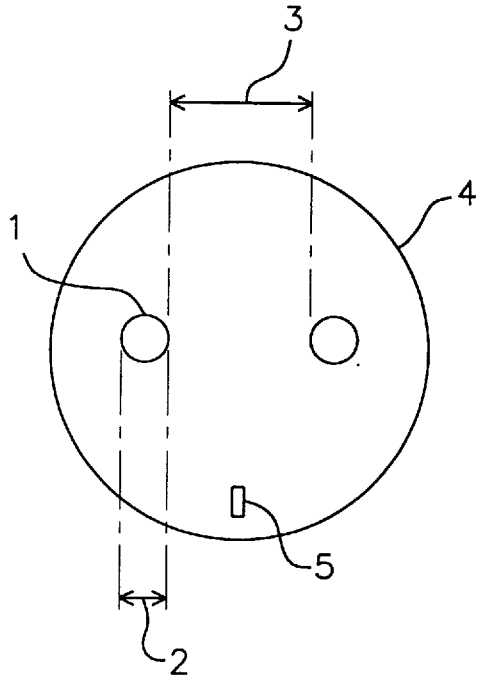
FIG. 1A is a face view of a nozzle with two primary orifices.
Figure 1B:
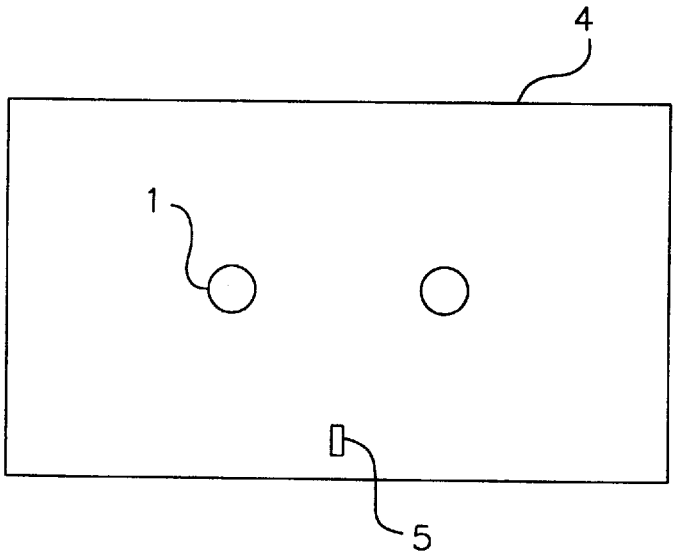
FIG. 1B is a face view of an alternative nozzle body of FIG. 1A.
Figure 2A:
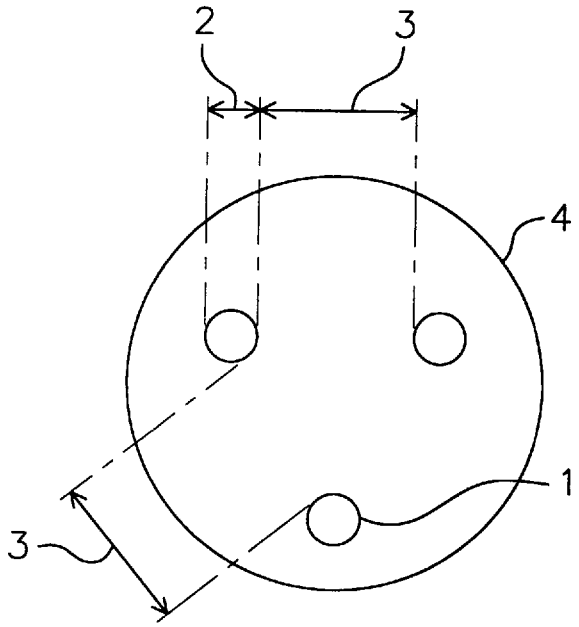
FIG. 2A is a face view of nozzle with three primary orifices, which are staggered.
Figure 2B:
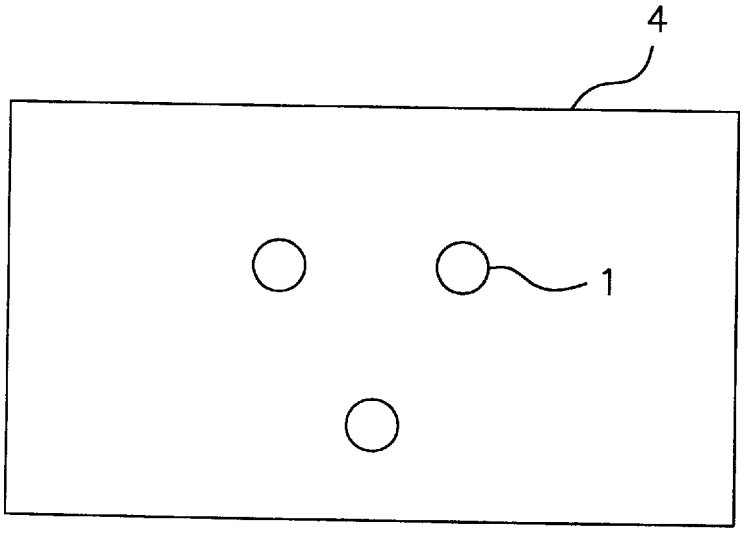
FIG. 2B is a face view of an alternative nozzle body of FIG. 2A.
Figure 3:
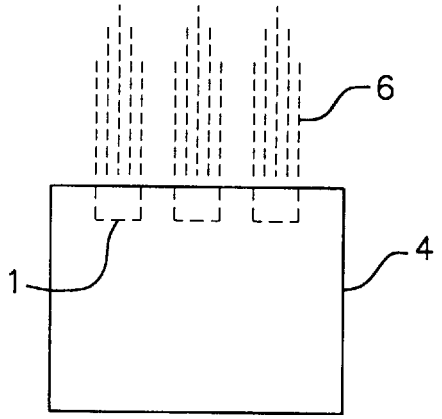
FIG. 3 is a top view of a nozzle with three primary orifices showing the spray paths.
Figure 5:
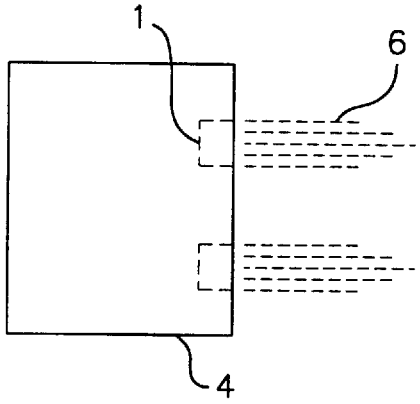
FIG. 5 is a side view of a nozzle with three primary orifices.

As shown in FIGS. 1A–5 a nozzle body 4, which can be of varying forms, materials or configurations (including multiple nozzles on a single sprinkler), has orifices 1 that are of the same size or area 2, placed about the face 9 of the nozzle body 4 at a distance apart 3 determined by a ratio of orifice diameter or size to the distance 3 between the orifice (s) 1 that discharge a stream 6 of water when the nozzle body 4 is retained or attached to a conductive waterway of a suitable sprinkler. If desired a reinforcing spray orifice 5 or orifices may be included on the face 9 of the nozzle body.

The nozzle body 4 can be made using existing metal and plastics equipment and technology. Metal nozzles can be mold formed, machined and finished, or machined from blank stock. Plastic nozzles can be injection molded either as one piece or combined from separate moldings. Methods of retaining the nozzle body in the sprinkler can include clamping, threading and screw retention. The nozzle can also use pressure compensation devices (not shown).

Figure 6:
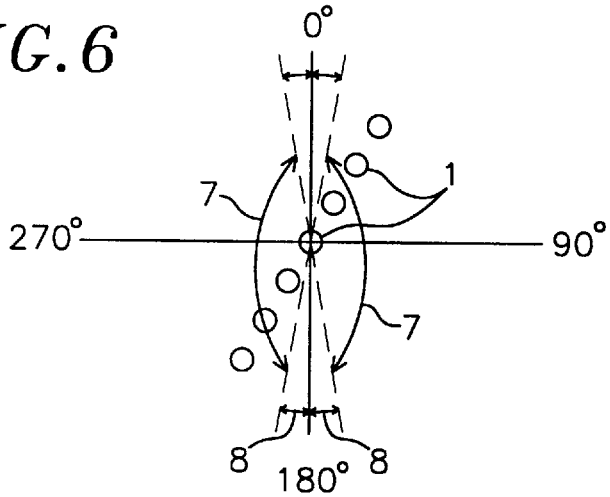
FIG. 6 is a schematic view of layout limits of orifices.
Figure 4A:
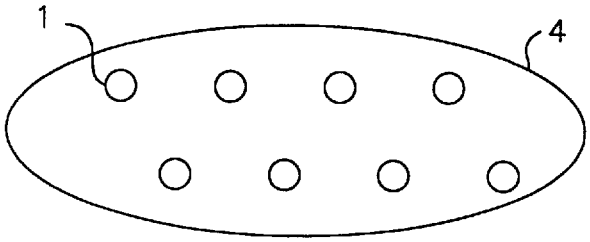
FIG. 4A–F are face views of alternative primary orifice configurations.
Figure 4B:
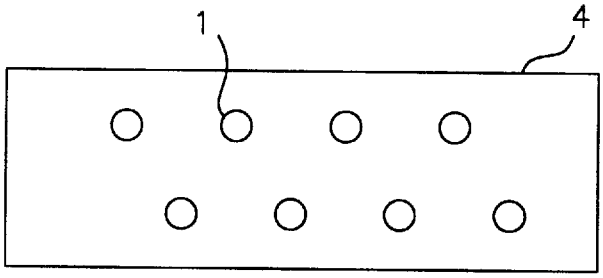
Figure 4C:
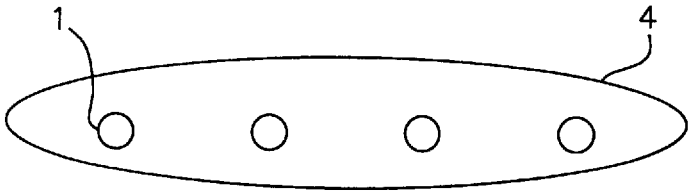
Figure 4D:
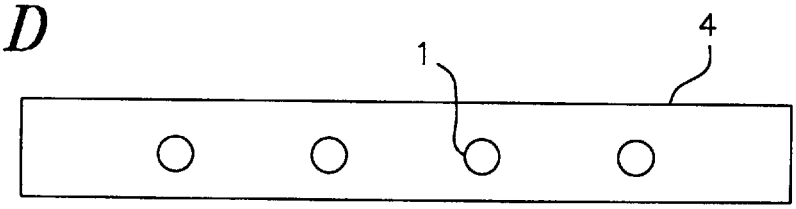
Figure 4E:
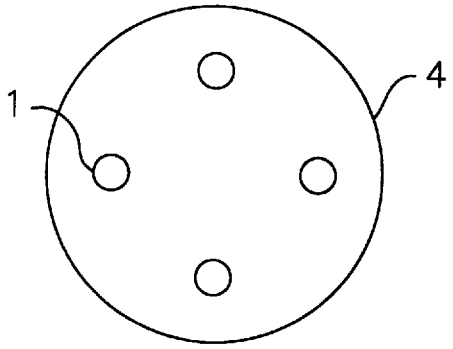
Figure 4F:
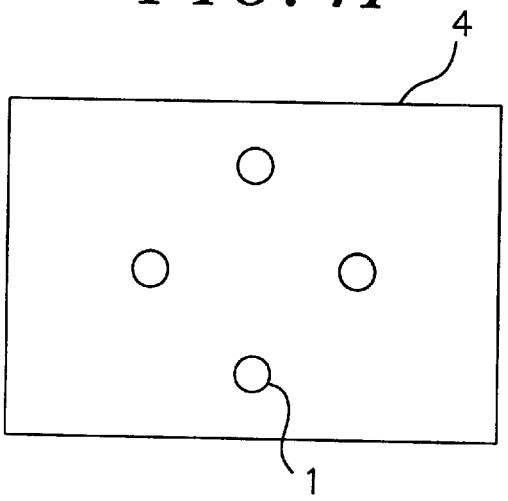

The nozzle body 4 can be made in a variety of shapes to accommodate both the number of primary orifices and the sprinkler body. For example, FIGS. 4A–F illustrate the nozzle as circular or elliptical, or square or rectangular as shown in phantom. Other geometric shapes are also possible. The primary orifices (s) 1 can be of a variety of shapes providing they are approximately the same overall size 2 to allow similar gallonage flows at similar velocities. The distance 3 between the orifices 1 is sufficient so as to prevent the individual water streams 6 or jets from joining (with adjacent streams or jets) until such distance precludes or inhibits the adjoining streams' ability to add their momentum to the newly recombined spray stream. This distance 3 has the above stated ratio in the range of about 1:2 to about 1:10. The first number in this ratio being the diameter or area 2 of the orifice 1, the second number being the distance 3 between the orifices measured from one orifice edge, expressed in orifice diameters 2. The exact distance depends on the exact orifice shape, conductive delivery system (stream straighteners or barrels) or configuration of the orifices. The orifices can be horizontally aligned, vertically aligned or staggered. As schematically depicted in FIG. 6, the orifices, if stacked, should not be placed in a zone that is eleven degrees 8 on each side of a vertical Azimuth (vertical being 0 degrees at top, 180 degrees at bottom). This allows orifice stacking in the remaining one hundred fifty-eight degrees 7 on the horizontal plane (the 90 degree to 270 degree Azimuth). This prevents an extra 'lift' to the upper stream, helping maintain the individual effective throw distance. Secondary orifices 5 can or may be added to the nozzle as close in area reinforcing sprays.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary sprinkler comprising:

a rotating sprinkler head; and a nozzle on the sprinkler head having at least a pair of nozzle orifices of similar size spaced equally apart and aligned parallel to each other and perpendicular to a face of the nozzle and having a nozzle orifice size to nozzle orifice spacing distance ratio of about 1:2 to about 1:10, said ratio being sufficient to produce separate nozzle streams which emerge from the nozzle face as separate streams which may join together or commingle only at a distance from said face which does not appreciably increase an overall velocity of a resultant stream or commingled stream so that the gallonage per minute delivered by the nozzle can be increased incrementally in multiples without appreciably increasing the distance thrown by the resultant water stream.

2. The sprinkler of claim 1 further including at least one reinforcing spray orifice on the nozzle face for in close application of water.

3. The sprinkler of claim 1 wherein said nozzle orifices are vertically aligned on said nozzle face.

4. The sprinkler of claim 1 wherein said nozzle orifices are horizontally aligned on said nozzle face.

5. The sprinkler of claim 1 wherein said nozzle orifices are staggered vertically and horizontally on said nozzle face.

6. The sprinkler of claim 1 wherein a plurality of nozzles are positioned on a horizontal plane and aligned vertically on the sprinkler head.

* * * * *

UNITED STATES PATENT AND TRADEMARK OFFICE

CERTIFICATE OF CORRECTION

PATENT NO. : 5,878,964
DATED : March 9, 1999
INVENTOR(S) : Dennis R. Hansen

It is certified that error appears in the above-identified patent and that said Letters Patent is hereby corrected as shown below:

Column 3, line 27, delete "a rotating sprinkler head; and".
Column 4, lines 1,2, replace "pair of nozzle" with -- pair of adjacent nozzle --.
Column 4, lines 4,5, replace "size to nozzle" with -- size to adjacent nozzle --.

Signed and Sealed this

Thirtieth Day of May, 2000

*Attest:*

Q. TODD DICKINSON

*Attesting Officer*

*Director of Patents and Trademarks*